US010286652B2

(12) United States Patent
Bonneton

(10) Patent No.: US 10,286,652 B2
(45) Date of Patent: May 14, 2019

(54) METHOD AND DEVICE FOR DETECTING THE PRESENCE OF JETS

(71) Applicant: Dover Europe Sárl, Vernier (CH)

(72) Inventor: Damien Bonneton, Hostun (FR)

(73) Assignee: DOVER EUROPE SÀRL, Vernier (CH)

( * ) Notice: Subject to any disclaimer, the term of this patent is extended or adjusted under 35 U.S.C. 154(b) by 0 days.

(21) Appl. No.: 15/840,166

(22) Filed: Dec. 13, 2017

(65) Prior Publication Data

US 2018/0162121 A1 Jun. 14, 2018

(30) Foreign Application Priority Data

Dec. 14, 2016 (FR) ..... 16 62445

(51) Int. Cl.
*B41J 2/045* (2006.01)
*B41J 2/12* (2006.01)
(Continued)

(52) U.S. Cl.
CPC ..... *B41J 2/0451* (2013.01); *B41J 2/04581* (2013.01); *B41J 2/105* (2013.01); *B41J 2/12* (2013.01); *B41J 2/125* (2013.01)

(58) Field of Classification Search
CPC ..... B41J 2/0451; B41J 2/04581; B41J 2/105; B41J 2/12; B41J 2/125; B41J 2/08; B41J 2/085; B41J 2/07; B41J 2/075
(Continued)

(56) References Cited

U.S. PATENT DOCUMENTS 4,598,299 A * 7/1986 Koike ..... B41J 2/12 347/79
7,192,121 B2 3/2007 Barbet et al.
(Continued)

FOREIGN PATENT DOCUMENTS

EP 1079974 A1 3/2001
JP S54104346 A 8/1979
(Continued)

OTHER PUBLICATIONS

Extended European Search Report for Application No. 17206352.1, dated May 3, 2018.
(Continued)

*Primary Examiner* — Huan H Tran
*Assistant Examiner* — Alexander D Shenderov
(74) *Attorney, Agent, or Firm* — Pearne & Gordon LLP

(57) ABSTRACT

The invention relates to a method for detecting the presence of a jet from a multi-jet print head of an inkjet printer comprising a plurality of nozzles (4), at least one 1st and one 2nd deviation electrode (14*a*, 14*b*) for each jet, in which: the inkjet is produced by one of the nozzles, at a frequency $f_{stim1}$, and is then charged by a voltage $V_{THT}$ at a frequency $f_{THT}$, $f_{THT}$ not being an integer multiple or sub-multiple of $f_{stim1}$; a jet charge signal is detected, derived from sampling, at frequency $f_{stim1}$, of the voltage at frequency $f_{THT}$, at least one spectral component of this signal being used to detect the presence of the jet.

20 Claims, 9 Drawing Sheets

(51) Int. Cl.
*B41J 2/105* (2006.01)
*B41J 2/125* (2006.01)

(58) Field of Classification Search
USPC ..... 347/14
See application file for complete search history.

(56) References Cited

U.S. PATENT DOCUMENTS

| | | | | |
|---|---|---|---|---|
| 2001/0001244 | A1 | 5/2001 | Rhodes | |
| 2005/0185031 | A1* | 8/2005 | Steiner | B41J 2/07 347/74 |
| 2013/0307891 | A1 | 11/2013 | Barbet et al. | |

FOREIGN PATENT DOCUMENTS

| | | | |
|---|---|---|---|
| JP | S56126176 | A | 10/1981 |
| WO | 2005023549 | A1 | 3/2005 |

OTHER PUBLICATIONS

Search Report for FR 1662445 dated Aug. 2, 2017.
U.S. Appl. No. 15/549,195 entitled B"System for Advanced Protection of Consumable or Detachable Elements", filed Aug. 7, 2017.
U.S. Appl. No. 15/656,613 entitled "Advanced Protection System for Consumable or Detachable Parts for an Industrial Printer", filed Jul. 21, 2017.

* cited by examiner

METHOD AND DEVICE FOR DETECTING THE PRESENCE OF JETS

This application claims priority from French Patent Application No. 16 62445 filed on Dec. 14, 2016. The content of this application is incorporated herein by reference in its entirety.

TECHNICAL DOMAIN AND PRIOR ART

The invention relates to print heads of printers or continuous inkjet printers, for example of the binary type provided with a multi-nozzle drop generator.

Continuous jet printers comprise an ink drop generator and means of separating trajectories of drops produced by the generator and directing them towards a printing support or to a catcher.

The drop generator comprises nozzles aligned on a nozzle plate along a nozzle alignment axis X. During printing, these nozzles eject inkjets continuously in a direction Z perpendicular to the nozzle plate. Continuous jet printers include deviated continuous jet printers and binary continuous jet printers. Drops formed in deviated continuous jet printers from a nozzle during the time taken to print a position on a print support may or may not be deviated. For each print position and for each nozzle, a segment perpendicular to the movement direction of the print support is printed. Deviated drops are deviated such that they will strike the print support on the required part of the printed segment, considering the motif to be printed. Undeviated drops are recovered in a catcher. Deviated continuous jet printers usually comprise few ejection nozzles, but each nozzle can print several pixels distributed on the print segment for each print position on the support, depending on the motif to be printed. In binary continuous jet printers, ink from a nozzle only prints one pixel for each print position. The pixel considered does not receive any drops or receives one or several drops as a function of the motif to be printed. Consequently, for a high printing speed, the nozzle plate comprises a large number of nozzles, for example 64, to enable simultaneous printing of one pixel for each nozzle. Drops that are not required for printing are recovered in a catcher or gutter.

Due to the large number of nozzles, a problem occurs when one of the nozzles does not function correctly, for example due to a blockage. There is no known means of detecting such a situation.

BRIEF DESCRIPTION OF THE INVENTION

The first purpose of this invention is a method for detecting the presence of a jet from a multi-jet print head of an inkjet printer comprising a plurality of nozzles, at least one $1^{st}$ and one 2nd deviation electrode for each jet, in which:

- said inkjet is produced or ejected by one of the nozzles, stimulated at a frequency $f_{stim1}$, then charged at a frequency $f_{THT}$, $f_{THT}$ not being an integer multiple or sub-multiple of $f_{stim1}$,
- a charge signal, or a representative or image signal of the charge, of the jet is detected, at least one spectral component of this signal being used to detect the presence of said jet.

Therefore the signal representative of the jet charge can be derived from sampling, at frequency $f_{stim1}$, of the voltage at frequency $f_{THT}$.

The other jets, produced or ejected by the other nozzles, can be stimulated at a frequency $f_{stim2}$ different from $f_{stim1}$, which solves the problem of crosstalk between jets.

Therefore each jet can be tested in the presence of all other jets or at least some of the other jets.

Therefore the stimulation frequency of the tested jet is preferably different from that of the other jets, and a frequency $f_{THT}$ is chosen that is not an integer multiple or sub-multiple of $f_{stim1}$. Otherwise, disturbances occur between the tested jet and the other jets. A sufficient spectral differentiation is thus obtained in the representative or image signal of the charge, between the frequency of interest and the other frequencies. A filter can also be implemented so as to separate this frequency of interest and the other frequencies in the representative or image signal of the charge.

According to one particular embodiment, the voltage $V_{THT}$ is applied to an electrode:

- for example at one of the deviation electrodes, the other deviation electrode then preferably being grounded,
- as a variant, and once again as an example, the print head comprises at least one $3^{rd}$ electrode, that can be a shielding electrode, to which the voltage $V_{THT}$ is applied, the deviation electrodes then preferably being grounded.

Preferably, the charge signal of the jet comprises a spectral component at at least one frequency $f_{a1}$ defined by:

$$f_{a1} = \left(\frac{f_{THT}}{f_{stim1}} - \left\lfloor \frac{f_{THT}}{f_{stim1}} \right\rfloor\right) * f_{stim1}$$

in which the function $\lfloor\ \rfloor$ designates the integer part.

Preferably, in order to satisfactorily separate the signals, the frequency $f_{stim1}$ being applied to the measured jet that is charged by voltage $V_{THT}$ at a frequency $f_{THT}$, the frequency $f_{stim2}$ applied to at least some of the other jets is such that:

- $f_{a1} \ll f_{a2}$ or $f_{a2} \ll f_{a1}$,
- and/or: $f_{a1} < f_c < f_{a2}$, or $f_{a2} < f_c < f_{a1}$, in which $f_c$ is the cutoff frequency of an amplifier or a filter of the charge signal.

$f_{a2}$ is calculated using the same formula as above by replacing $f_{stim1}$ by $f_{stim2}$.

A plurality of spectral components of the charge signal can be detected in each measured signal, the sum of the intensities of several of these spectral components being at least partly made to detect the presence of said jet.

Charge detection means are provided, for example by a catcher of a jet not used for printing, this catcher being made of a conducting material, for example metallic, or by a dedicated electrode or by a charge detector.

The presence or absence of a jet from the multi-jet print head can be detected for each jet from the print head successively.

An algorithm with several thresholds, for example 3 thresholds, can be applied to the charge signal or to at least one of its spectral components.

The invention also relates to a print method using an inkjet printer comprising a multi-jet print head, comprising a step to print at least one motif on a support before and/or after application of a method according to the invention, for detecting the presence of one or several jet(s) from said multi-jet print head. Therefore it is possible to stop a printout and then to implement a detection method according to the invention, and/or to stop a detection method according to the invention and then to make a printout.

During a print step, alternating voltages in phase opposition are applied to the $1^{st}$ and 2nd deviation electrodes, for example such that the temporal and spatial average of the electric field E is zero. The jet is then not charged, unlike a detection method according to the invention.

Another object of this invention is a device for detecting the presence of a jet from a multi-jet print head of an inkjet printer, comprising a plurality of nozzles, at least one $1^{st}$ and one 2nd deviation electrode for each jet, this device comprising:

means adapted to produce or eject said inkjet through one of the nozzles, and to stimulate it at a frequency $f_{stim1}$, means of applying a charge to said jet at a frequency $f_{THT}$, $f_{THT}$ not being an integer multiple or sub-multiple of $f_{stim1}$, detection means to detect at least one spectral component of a jet charge signal, or a representative or image signal of the charge, to detect the presence of said jet.

Therefore the signal representative of the jet charge can be derived from sampling, at frequency $f_{stim1}$, of the voltage at frequency $f_{THT}$.

The other jets, produced or ejected by the other nozzles can be stimulated at a frequency $f_{stim2}$ different from $f_{stim1}$, which solves the problem of crosstalk between jets.

In other words, the device preferably comprises means adapted to produce or eject said inkjet through the other nozzles, or through at least some of them, and stimulate them at a frequency $f_{stim2}$ different from $f_{stim1}$.

Therefore each jet can be tested in the presence of all other jets or at least some of the other jets.

Therefore the stimulation frequency of the tested jet can be different from that of the other jets, and a frequency $f_{THT}$ is chosen that is not an integer multiple or sub-multiple of $f_{stim1}$. Otherwise, disturbances occur between the tested jet and the other jets. A sufficient spectral differentiation is thus obtained in the representative or image signal of the charge, between the frequency of interest and the other frequencies. A device according to the invention can make use of a filter to separate this frequency of interest and the other frequencies in the representative or image signal of the charge.

If a jet is missing, which can be observed by a method or device according to the invention, the head can be cleaned.

According to one particular embodiment, a device according to the invention comprises means of applying said voltage $V_{THT}$ to one of the deviation electrodes, or to a $3^{rd}$ electrode, for example a shielding electrode.

Means can be provided to hold the other electrode(s) connected to the ground.

The charge signal of the jet may comprise a spectral component at at least one frequency fa defined by:

$$f_{a1} = \left(\frac{f_{THT}}{f_{stim2}} - \left\lfloor \frac{f_{THT}}{f_{stim1}} \right\rfloor\right) * f_{stim1}$$

in which the function $\lfloor\ \rfloor$ designates the integer part.

A device according to the invention may also comprise means of producing a jet at a frequency $f_{stim2}$ for at least some of the other jets, $f_{stim1}$ and $f_{stim2}$ being such that:

$f_{a1} \ll f_{a2}$ or $f_{a2} \ll f_{a1}$, and/or: $f_{a1} < f_c < f_{a2}$, or $f_{a2} < f_c < f_{a1}$, in which $f_c$ is the cutoff frequency of an amplifier or a filter of the charge signal.

$f_{a2}$ is calculated using the same formula as above by replacing $f_{stim1}$ by $f_{stim2}$.

A device according to the invention may comprise means of detecting a plurality of spectral components of the charge signal, and taking the sum of the intensities of several of these spectral components.

Charge detection means are provided, for example by a catcher of a jet not used for printing, this catcher being at least partly made of a conducting or metallic material, or by an electrode or by a charge detector.

Means are capable of or are programmed to process a charge signal detected by the charge detection means.

A device according to the invention is designed to or is programmed to detect the presence or absence of a jet from the multi-jet print head successively for each jet of the print head.

A device according to the invention can be designed for or programmed to make use of an algorithm with several thresholds, for example 3 thresholds, to process the charge signal or at least one of its spectral components.

The invention also relates to a print device of an inkjet printer comprising a multi-jet print head, comprising:

means of printing at least one motif on a support, means of stopping a printout and capable of using, or being programmed to use a method according to the invention, for detecting the presence of one or several jet(s) from said multi-jet print head.

The invention also relates to a print device of the inkjet printer type comprising a multi-jet print head, comprising:

means of printing at least one motif on a support, means of stopping a printout and capable of using, or being programmed to use a method according to the invention, for detecting the presence of one or several jet(s) from said multi-jet print head.

The invention also relates to an inkjet printer comprising:

a multi-jet print head, a device to detect the presence of a jet from the print head according to the invention, means of supplying ink and/or solvent to the print head.

BRIEF DESCRIPTION OF THE DRAWINGS

An example embodiment of the invention will now be described with reference to the appended drawings among which.

Similar or identical technical elements are designated by the same reference numbers on the different figures.

DETAILED DESCRIPTION OF EMBODIMENTS

Figure 1:
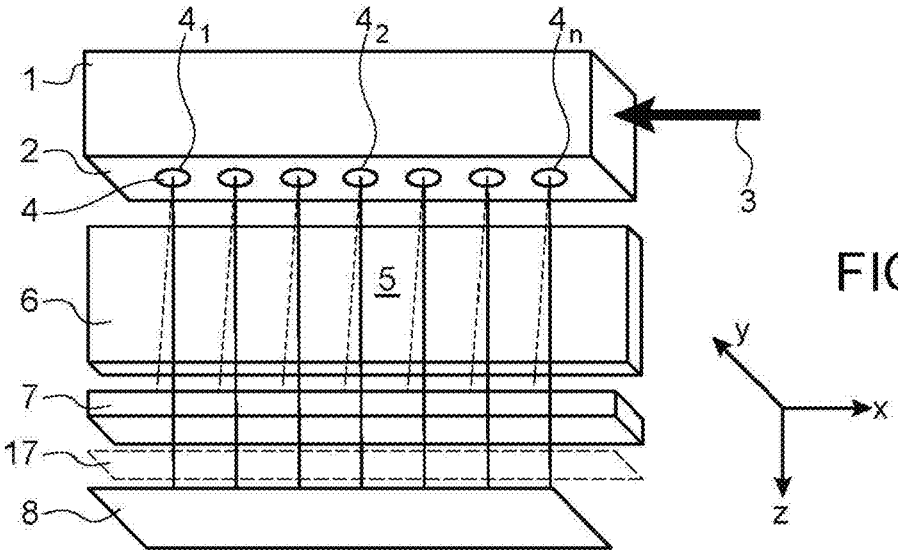
FIG. 1 represents a diagrammatic isometric view of a print head, showing principally the components of the print head located downstream from the nozzles.

A general structure of a print head is described below with reference to FIG. 1.

The head includes a drop generator 1. This generator comprises an integer number n of nozzles 4 aligned on a nozzle plate 2 along an X axis (lying in the plane of the figure), including a first nozzle $\mathbf{4}_1$ and a last nozzle $\mathbf{4}_n$.

The first and the last nozzles ($\mathbf{4}_1$, 4n) are the nozzles with the greatest distance between them.

Each nozzle has a jet emission axis parallel to a Z direction or axis (located in the plane of FIG. 1), perpendicular to the nozzle plate and to the X axis mentioned above. A third axis, Y, is perpendicular to each of the X and Z axes, the two X and Z axes extending in the plane of FIG. 1.

The nozzle $\mathbf{4}_x$ can be seen on the figure. Each nozzle is in hydraulic communication with a pressurized stimulation chamber. The drop generator comprises one stimulation chamber for each nozzle. Each chamber is provided with stimulation means or an actuator, for example a piezoelectric crystal. An example design of a stimulation chamber is described in document U.S. Pat. No. 7,192,121.

There are sort means or a sort module 6 downstream from the nozzle plate, that will be used to separate drops used for printing from drops or jet segments not used for printing.

The drops or jet segments emitted by a nozzle and that will be used for printing follow a trajectory along the Z axis of the nozzle and strike a print support 8, after having passed through an outlet slit 17. The slit is open to the outside of the cavity and ink drops to be printed exit through it; it is parallel to the X direction of nozzle alignment, the Z direction axes of the nozzles passing through this slit, that is on the face opposite the nozzle plate 2. Its length is equal to at least the distance between the first and the last nozzle.

Drops or jet segments emitted by a nozzle and not intended for printing, are deviated by means 6 and are recovered in a gutter or a catcher 7 and then recycled. The length of the catcher along the X direction is equal to at least the distance between the first and the last nozzle.

Figure 2:
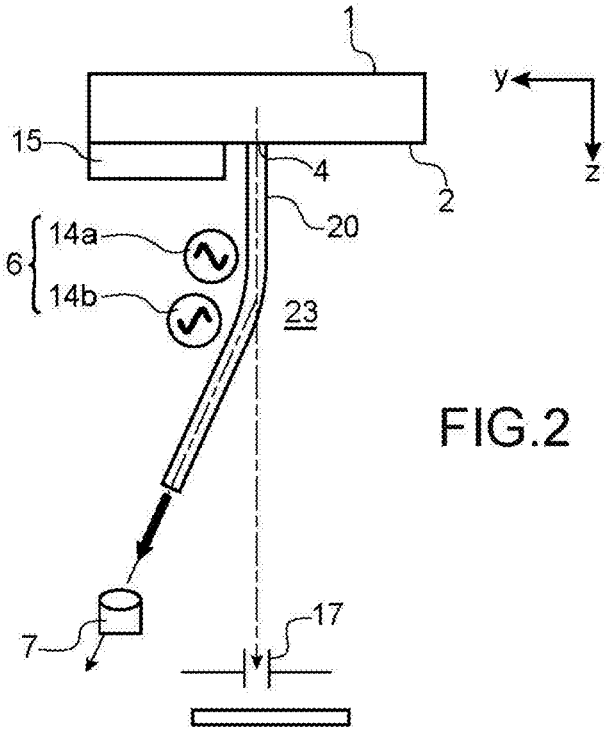
FIG. 2 represents a diagrammatic sectional view of a cavity of a print head according to one aspect of the invention, this section being taken in a plane parallel to the YZ plane and containing one of the Z axes of a nozzle.

FIG. 2 represents an operating principle of a print head that can be used in the framework of the invention.

This figure is a sectional view made in a plane parallel to the YZ plane, containing the Z axis of a nozzle 4. The shape of the representation of each section remains the same over the distance from the first nozzle $\mathbf{4}_1$ to the last nozzle $\mathbf{4}_n$ along the X direction (perpendicular to the plane in FIG. 2).

The drop generator is equipped with a shielding electrode 15. This electrode extends perpendicular to the plane of FIG. 2 and is therefore common to all jets.

This electrode limits the influence zone of radiation from deflection electrodes 14*a* and 14*b* placed below.

The print head is also provided with a set 6 of two electrodes 14*a*, 14*b* (or 2 electrodes 14*a*, 14*b* each associated with a grounded electrode), positioned along the path of a jet 20 produced by the generator 1. These electrodes extend perpendicular to the plane of FIG. 2 and are therefore common to all jets.

During printing, such a head functions as follows.

The 2 electrodes 14*a*, 14*b* generate a variable electric field E to which the jet 20 and all other jets are exposed; they are powered at variable potentials to achieve this.

In particular, according to one embodiment, the electrodes 14*a*, 14*b* can be powered such that the temporal average of the electric field E is zero, or practically zero, or low; thus, the jet 20 is electrically neutral in the influence zone of the electrodes 14*a*, 14*b*; however, the positive and negative charges distributed in the jet 20 by the electrodes are separated, such that deflection can be guaranteed. Thus, at all times, the quantity of charge with a positive sign induced on the jet 20 by the electrode powered by a negative signal is practically equal to the quantity of charge with a negative sign induced on the jet 20 by the electrode powered by a positive signal. Therefore there is no or little circulation of electrical charges over long distances in the jet 20, particularly between the nozzle 4 and the electrical influence zone of the electrodes.

In one preferred embodiment, the 2 electrodes have the same geometry and, when printing, the electrical signals for each electrode have identical amplitude, frequency and shape, but are out of phase (in phase opposition for the pair of electrodes).

The two electrodes can have the same dimension h along the direction of the hydraulic trajectory A, separated by an electrical insulator. Each electrode can be powered by a variable high voltage signal with a given amplitude $V_0$, with identical frequency F and shape but that are 180° out of phase. The electrodes 14*a*, 14*b* and possibly an insulator separating them are preferably at approximately the same distance from the hydraulic trajectory defined by the axis of an undeviated jet output from the nozzle 4, the influence zone of the electrodes 4*a*, 4*b* extends towards the jet 20, over a short distance.

According to one particular embodiment, at a given time $t_0$, the first electrode 14*a* with positive charge induces a charge with the opposite sign (−) on the surface of the facing jet 20, creating an attractive force between the portion of the jet under electrostatic influence and the electrode 14*a*. Similarly, the negatively charged electrode 14*b* induces a charge with the opposite sign (+) on the portion of the jet 20 facing it, also creating an attractive force proportional to the square of the induced charge. Under the action of the forces created by the two electrodes 14*a*, 14*b*, the jet 20 is deviated from its hydraulic trajectory and tends to move towards the electrodes 14*a*, 14*b*.

In this configuration that is symmetric regarding the signal but also the geometry of the electrodes, the electrostatic action induces an electric dipole in the jet 20, the charges involved in the dipole originating from separation of the positive and negative charge carriers (the ions) inside the jet 20. It should be noted that this charge separation phenomenon is different from the charge transfer mechanism by conduction from the nozzle plate 4 (in which the jet 20 is for example grounded) to the influence zone of the electrodes 14*a*, 14*b*. In particular, the jet 20 remains at zero average charge if the ink, the reservoir and the nozzle 4 are grounded. The segments that will be used for printing are created upstream from the first electrode 14*a*. Thus, they do not carry any charge at the time of their formation.

The result obtained is thus a deflection of a continuous jet 20 through localised charges, without charging the complete jet.

Consequently the jet 20 and all other jets in the influence zone of the electrodes 14*a*, 14*b* are electrically neutral, while separating positive charges from negative charges. Any other combination of electrodes (size, potential, distribution, number) capable of satisfying these two conditions respects this principle. FIG. 2B in FR 2906755 illustrates an example (not reproduced herein), in which the set of electrodes 20 comprises an alternation of electrodes brought to the same potential with electrodes brought to the opposite potential; the electrodes are separated by insulators, preferably all with the same nature and dimensions.

As a variant, any of the other electrode structures presented in document FR 2906755 can be used.

Aspects described in this document related to production of the different envisaged solutions can also be used in the framework of this invention.

In particular:

- the length of jet segments said to be deflected and not used for printing is preferably greater than or equal to the total height L of the electrodes network (measured along the Z axis),
- the length of jet segments said to be undeflected and that will form drops to be printed is preferably less than the shortest distance H separating two adjacent electrodes,
- the electrodes are preferably coated with an electrically insulating layer. This insulating layer improves safety. It makes it possible to apply higher voltages to coated electrodes. This insulator also makes it possible to cut off dc field components.

As explained above, the field generated by the two electrodes is globally cancelled when the two electrodes are brought to exactly the same potential but with a phase shift of 180°. In this case the jet does not carry any charge, since the jet segment facing the two electrodes is globally neutral.

A measurement according to one embodiment of the invention can be made by bringing the shielding electrode 15 to an alternating potential while the two electrodes 14*a* and 14*b* are grounded, so that each segment of the jet 20 and of all the other jets located facing the electrode 15 can be charged, therefore giving a signal related to electrical charges, that can then be detected and analysed. Therefore each jet is charged, and consequently these conditions are different from those in which it is possible to make a printout and that have been described above.

Therefore a detection method according to the invention will be implemented before and/or after a printout on a substrate 8 (FIG. 1).

In the framework of a detection method according to the invention, a jet for which the presence is to be detected is produced by a stimulation chamber. The piezoelectric means of this chamber is then activated by a periodic voltage $V_{stim1}$, at at least one frequency $f_{stim1}$ (note that there can be more than one frequency in this signal) for example according to FIG. 3, in which pulses with amplitude 15 V and a duration of about 1 μs (more generally, this duration of each pulse is called the cutoff time) are applied with a period of 1 ms. The piezoelectric means of the other chambers and therefore the other jets are then activated by a periodic voltage $V_{stim2}$, at at least one frequency $f_{stim2}$ different from $f_{stim1}$. As explained below, $f_{stim1}$ is chosen to be different from a multiple or sub-multiple of $f_{THT}$.

A signal $V_{THT}$ of a voltage supply, said signal $V_{THT}$ being also periodic and synchronous with the voltage $V_{stim1}$ and comprising at least one frequency $f_{THT}$ (once again there can be more than one frequency in this signal), is applied to the shielding electrode 15, while the electrodes 14*a* and 14*b* are grounded. $f_{THT}$ is not a multiple or sub-multiple of $f_{stim1}$. In this case, the jet is not deviated and can be recovered in a catcher, preferably mobile, positioned on its path for the measurement; this catcher is withdrawn during the print phases.

According to one example, $f_{stim1}$=1025.64 Hz while $f_{THT}$=86 kHz.

According to another example:

- the amplitude of the voltage $V_{THT}$ applied to the shielding electrode 15 is 800V RMS,
- the gain of the measurement amplifier is $10^6$,
- a 32 MHz clock is divided by 370 to give an 86 kHz clock for the voltage $V_{THT}$ and is divided by 31200 which gives a frequency of 1025.64 Hz for the periodic voltage $V_{stim1}$; any other division is acceptable provided that the condition according to which $f_{THT}$ is not a multiple of $f_{stim1}$ is respected.

The combination of the 2 signals $V_{stim1}$ and $V_{THT}$ results in the periodic creation of a segment that carries a variable charge, the charged segment creation periods alternating with periods in which the jet arrives in the uncharged catcher (because $V_{THT}$ and possibly $V_{stim1}$ are not applied). In practice, the signals $V_{THT}$ and $V_{stim1}$ may not be applied continuously: for example, the case in which the jet is not measured (but is not deviated and for example goes into the mobile catcher) can be alternated with cases in which a segment is charged and measured (and possibly deviated, according to the other variants mentioned later).

The segment is neutral during the print phase, while it is charged during a measurement according to the invention. The jet comprising a charged segment performs a sampling function by isolating, at an instant t, the charge induced by the alternating potential of the electrode.

From a signal processing point of view, the combination of 2 periodic signals effectively samples a sinusoidal signal with a frequency of $f_{THT}$ at a frequency $f_{stim1}$. Sub-sampling can be done that introduces a spectral component at a frequency $f_{a1}$ given by the following equation:

$$f_{a1} = \left(\frac{f_{THT}}{f_{stim1}} - \left\lfloor \frac{f_{THT}}{f_{stim1}} \right\rfloor\right) * f_{stim1}$$

(therefore $f_{a1}$ is given by the difference between the ratio $f_{THT}/f_{stim1}$ and its integer part, all multiplied by $f_{stim1}$).

A similar equation is valid for negative frequencies $f_{b1}=-f_{a1}$.

In the example presented above ($f_{stim1}$=1025.64 Hz while $f_{THT}$=86 kHz): $f_{a1}$=332.64 Hz.

Periodisation, in the spectral domain, created by sampling also introduces spectral components at other frequencies: $f_{a1}+f_{stim1}$, $f_{a1}+2*f_{stim1}$, . . . and $f_{b1}+f_{stim1}$. $f_{b1}+2*f_{stim1}$ . . . .

These spectral components, that are a result of spectral folding, are found in the charge signal carried by the ink segment and that can be detected as explained below.

Figure 4A:
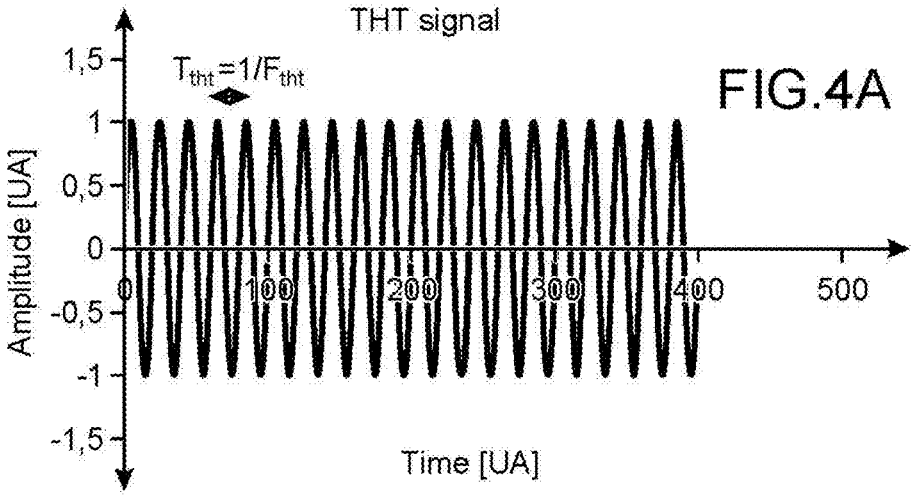
FIG. 4D represents the result of sampling at frequency $f_{stim}$ of a charged ink segment at frequency $f_{tht}$.
FIG. 4E represents the Fourier Transform (FFT) of the signal in FIG. 4D.
Figure 4B:
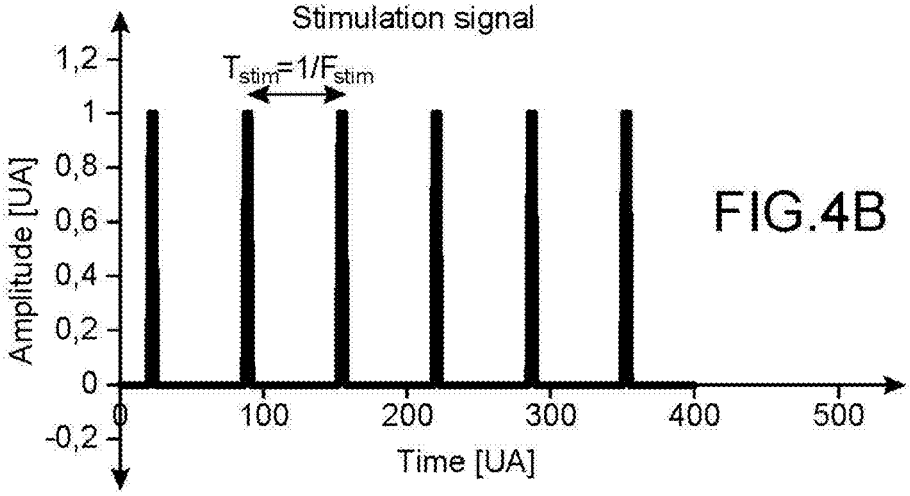
Figure 4C:
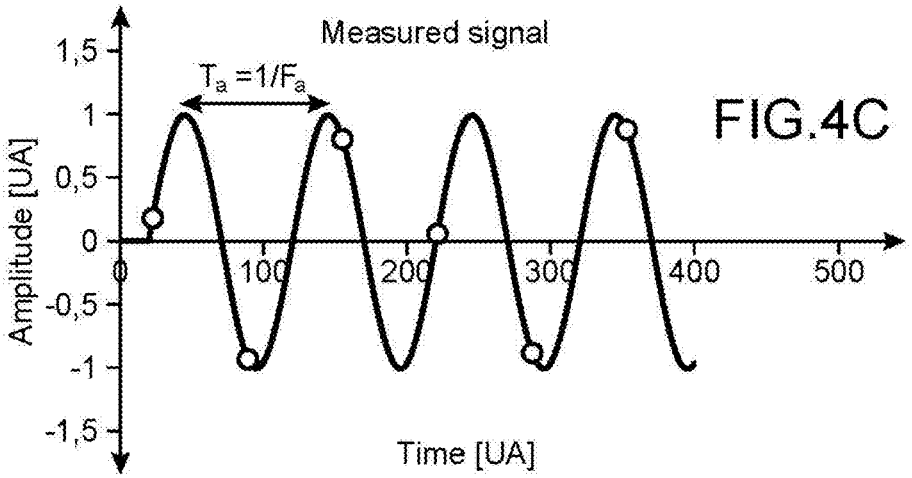

FIG. 4A diagrammatically shows a sinusoidal THT signal, FIG. 4B represents a stimulation signal at frequency $f_{stim1}$, and FIG. 4C shows the result of the combination of the 2, that illustrates the sampling thus made.

Figure 4D:
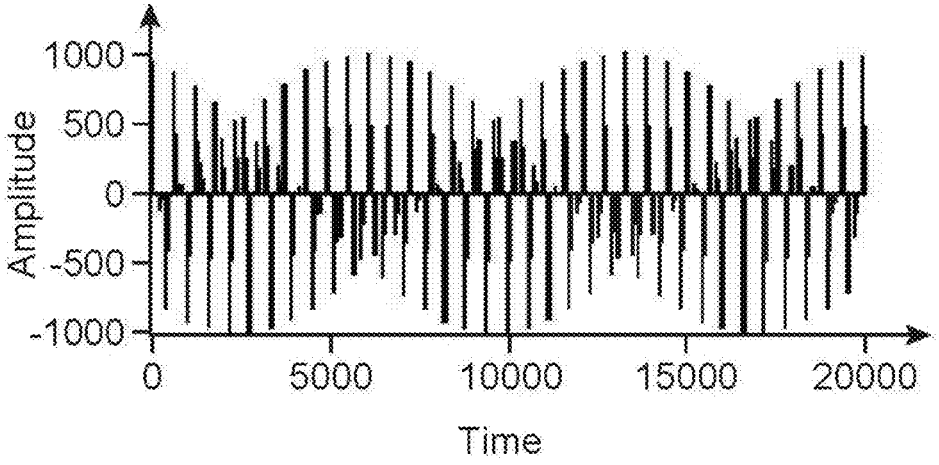
Figure 4E:
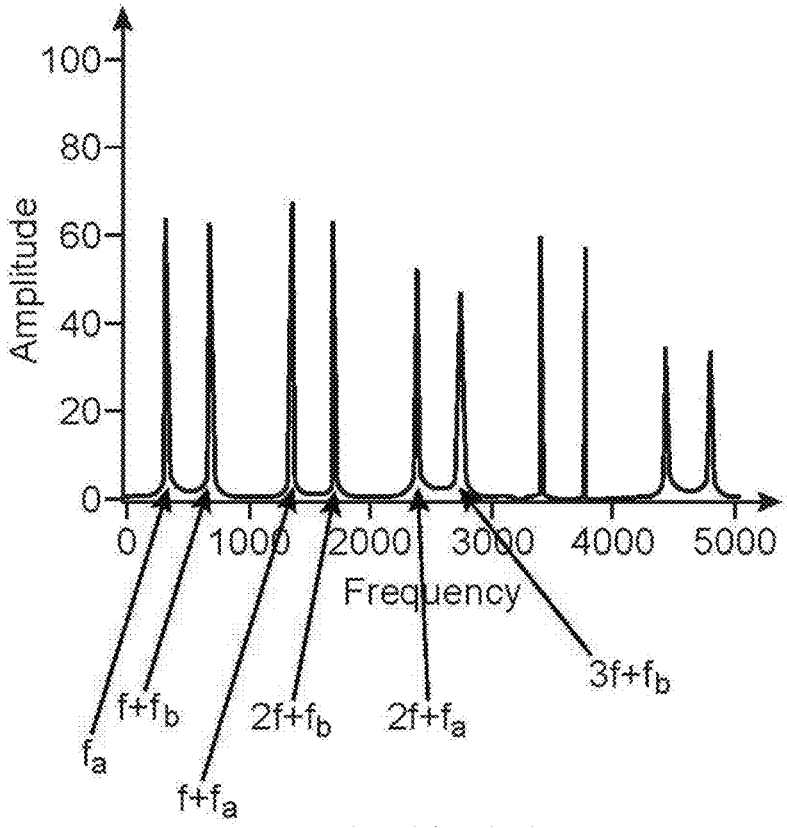

FIG. 4D represents the result of sampling at frequency $f_{stim1}$ (the conditions are as mentioned above). FIG. 4E represents the FFT of this signal, that is therefore the result of sampling according to what has been explained above; the components of the signal can be seen at frequencies $f_{a1}$, $f_{stim1}-f_{a1}$, $f_{stim1}+f_{a1}$, $f_{a1}+2*f_{stim1}$, $f_{b1}+f_{stim1}$, $f_{b1}+2*f_{stim1}$ . . . .

Detection of a signal at one or several of these frequencies, or detection of the presence of one or several of these frequencies by a spectral or frequential analysis of the measured charge signal, demonstrates the presence of a jet. If the jet is not present, no signal would be detected at any of these frequencies, or only a low or very low amplitude signal would be detected at any one of these frequencies.

For example, the sum of signals at several of these frequencies, for example 4, can be made; this is done by selecting the frequencies for which the intensities or amplitudes are highest, the intensity of other frequential components being attenuated by the passband or bandwidth of the measurement amplifier.

Figure 5:
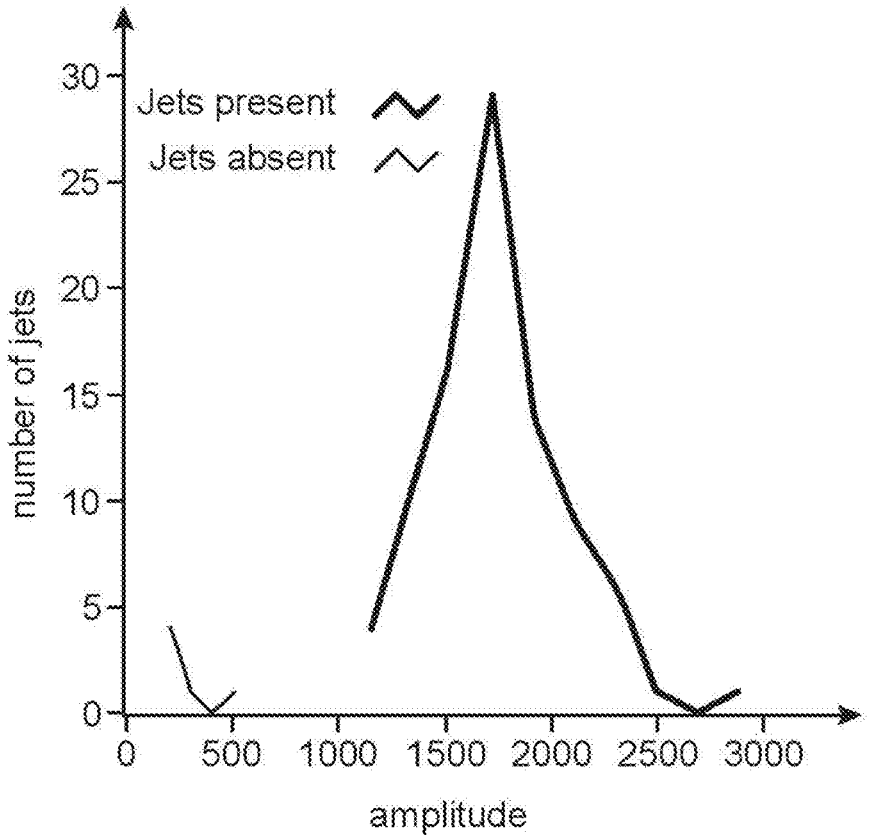
FIG. 5 represents the result of a measurement made according to the invention.

A series of measurements was made in the case of a print head in which some jets are absent and the dispersion of the amplitude of the line at frequency $f_{a1}$, measured for present jets are for absent jets, was traced. For each discrete amplitude value, the number of jets with this amplitude is measured and the result is shown on FIG. 5, that represents the results obtained in the case in which the voltage $V_{THT}$ is 700 V ($f_{THT}$=86 kHz $f_{stim1}$=1025.64 Hz), shielding being placed under the electrode 14*b*. Note that these results were derived by charging the electrode 14*a*, and not 15 (but that is preferred to limit crosstalk).

It can be seen that for present jets, the signal can be clearly identified and is much stronger than the signal for absent jets (the signal corresponding to absent jets is composed of noise).

One or several measurements can be made for each jet. For this purpose, each jet is produced with a stimulation voltage $V_{stim1}$, at at least one frequency $f_{stim1}$, (as explained later, the other jets preferably being produced at at least one frequency $f_{stim2}$ different from $f_{stim1}$) while a signal $V_{THT}$ also periodic, synchronous with the voltage $V_{stim1}$, with frequency $f_{THT}$ is applied to the shielding electrode 15. Details about choices of these frequencies were given above. Thus the process is continued jet by jet. Once all the jets have been tested positively, a printout can be made but with a different electrode operating method from that applicable during a measurement. If a jet is tested negatively (no signal), then the head can be cleaned.

When applying a method according to the invention, an algorithm with several thresholds, for example 3 thresholds, can be created:

- if the signal from a jet is more than a 1$^{st}$ predetermined threshold S1, it is concluded that the jet in question is present,
- if the signal from a jet is less than a 2$^{nd}$ predetermined threshold S2 (S2<S1), it is concluded that the jet in question in absent,
- if the signal from a jet is between S1 and S2, it is concluded that the jet in question is present if, after the measurement has been repeated a certain number Nr of times (for example: Nr=5), the signal is higher than a 3$^{rd}$ threshold S3 (S2<S3<S1) for some (for example 3) of the Nr measurements.

For example, S1=1200, S2=500 and S3=800.

Figure 6:
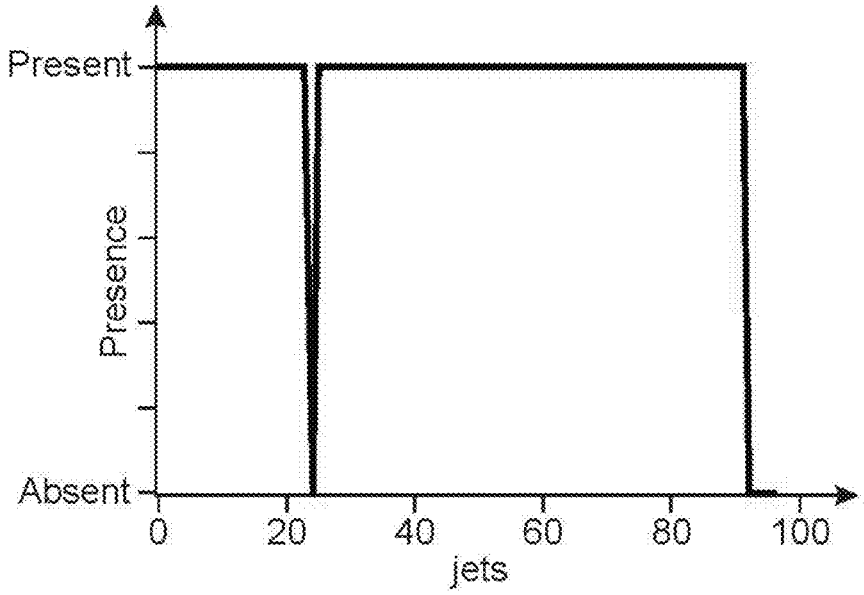
FIG. 6 represents the result of the application of an algorithm with several thresholds to a measurement made according to the invention.

FIG. 6 represents the result of such an algorithm: this figure corresponds to a situation in which all jets are present except for 23 and jet 96, which can be seen clearly.

The printer controller controls application of the stimulation signals $V_{stim1}$, $V_{stim2}$, and $V_{THT}$. During printing, voltage signals are applied to electrodes 14*a*, 14*b*, as explained above.

For detection, an electrical signal is detected due to charges carried by each ink segment, using a catcher 7 (possibly free to move as mentioned above), if it is made from a conducting material, or using an electrode, for example in the form of a line or using a sensor as described in document U.S. Pat. No. 8,511,802, this line or this sensor possibly being located under the deflection electrodes 14*a*, 14*b*. These means (catcher made of a conducting material or electrode) are connected to signal processing means (possibly by FFT) that may comprise filter means to select signals at the required frequencies. These signal processing means can make use of the controller itself and/or the controller may include such signal processing means.

As a variant to the method described above, the signal $V_{THT}$ is applied to one of the electrodes 14*a*, 14*b* (the other electrode and the shielding electrode 15, if any, being grounded). However, for reasons related to the crosstalk phenomenon explained below, it is preferable to apply it to the electrode 15 furthest from the zone in which several jets break.

As another variant to the method described above, the signal $V_{THT}$ of the voltage supply is applied to an electrode other than one of the electrodes 14*a*, 14*b* and other than the shielding electrode 15, if any (these electrodes 14*a, b* and possibly 15 can then be grounded). Once again, for reasons related to the crosstalk phenomenon explained below, it is preferable to apply it to the electrode 15 furthest from the zone in which several jets break. In this case, the method uses the same equations and the same detection principles as described above.

In the context of these variants, the jet is not necessarily deviated and recovered in a catcher, preferably mobile, positioned on its path for the measurement; this catcher is withdrawn during the print phases.

If the jet is deviated, for example by the application of at least one deviation voltage to at least one of the electrodes 14*a*, 14*b*, it can be recovered by the catcher 7 (positioned as in FIG. 2).

In these variants, the method uses the same equations and the same detection principles as described above.

Another phenomenon can create a problem in making the measurements disclosed above; this is the crosstalk problem, in other words the influence that the adjacent unstimulated jets can have on the signal from one jet measured as explained above; these other jets will also be stimulated, but more weakly, at the stimulation frequency $f_{stim1}$,all jets being subjected to the same voltages applied to the various electrodes. In other words, if a single frequency $f_{stim1}$ is used to stimulate the studied jet while the other jets break by a natural break, each of these other jets will receive a small quantity of energy to also break at frequency $f_{stim1}$.

A digital simulation of the potential applied to the jet, firstly relative to the charge electrode and secondly relative to the location of the break by crosstalk shows a significant contribution of objects broken by cross-talks. For example, by applying a stimulation signal to the order i jet, adjacent order i−1 and i+1 jets, and even order i−2 and i+2 jets will receive (by electrical, mechanical or hydraulic type cross-talk) a fraction of the stimulation, possibly 1% of that received by the order i jet. This mechanism will cause unwanted break of jets adjacent to the stimulated jet, at frequency $f_{stim1}$. The breaks will cause charges in adjacent jets and the sum of these charges will be at a level similar to the charges in the stimulated jet.

Figure 7A:
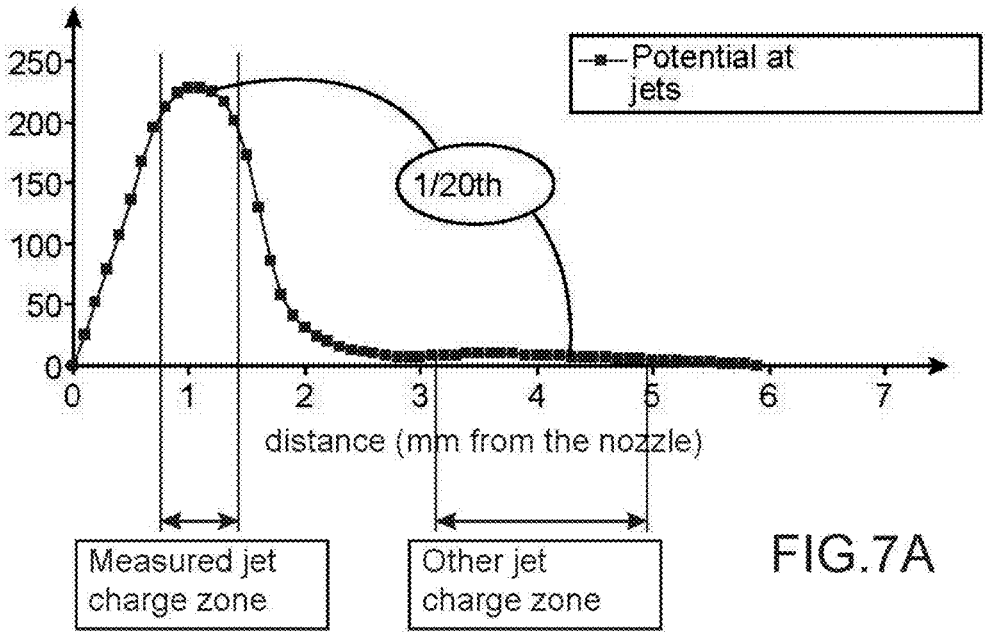
FIG. 7A represents the intensity of a potential applied to, or seen by, the jet in the charge zone, and also a contribution (due to a break by crosstalk) of jets not measured in the break zone.

This simulation is illustrated in FIG. 7A that shows firstly the intensity of the signal in the charge zone of the measured jet, and secondly an obviously much lower contribution (with an amplitude of 1/20 of the signal for the measured jet) but that is not negligible, of a jet not measured in the break zone; this contribution originates from the crosstalk phenomenon. When added on several jets, for example 63 jets if the head comprises 64 nozzles, this contribution related to crosstalk is no long negligible compared with that measured for a single jet.

Consequently, it is difficult to eliminate the influence of the charge carried by the jets broken by crosstalk; thus unstimulated jets will always tend to break at the frequency $f_{stim1}$ of the stimulated jet alone and therefore contribute to part of the measured signal.

Figure 7B:
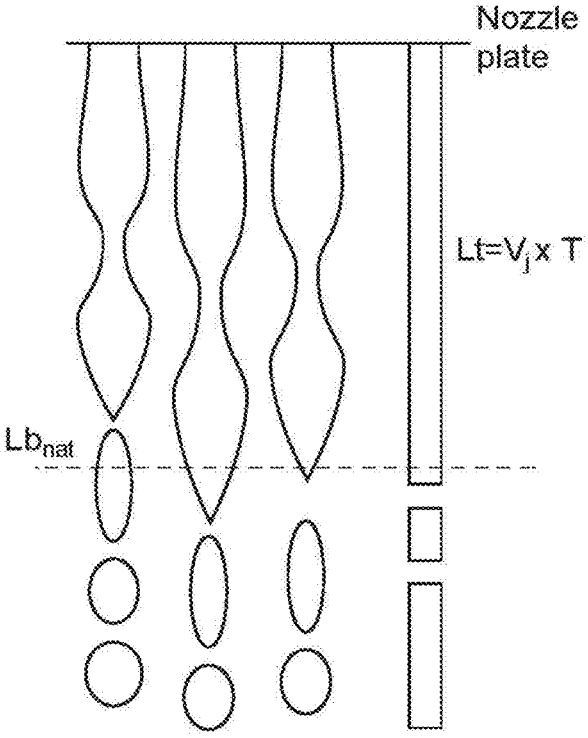
FIG. 7B represents the natural break of different ink segments, at different distances from the nozzle plate.
Figure 7C:
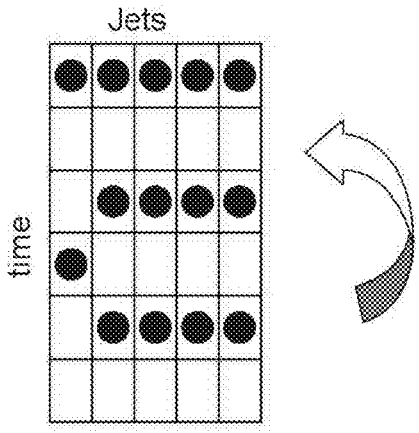
FIG. 7C represents a "descriptive" image in which the black dots represent jets, measured and not measured, the ordinate position being dependent on the print speed.

To solve this problem, an attempt is made to control the frequency at which these jets break, and to choose the frequency generated on the measurement, for example such that the frequencies obtained by sampling and spectral folding for the other jets (that are not measured) are different from the frequencies obtained by sampling and spectral folding for the measured jet, and are preferably located outside the pass band or bandwidth of the amplifier. Also preferably, an attempt is made to avoid producing excessively long segments, which would tend to break at the location of the break by crosstalk before the forced break location and at the frequency of the jet at which the measurement is to be made. As shown in FIG. 7B, that represents 3 jets that break at different distances from the nozzle plate 2. The natural break length $Lb_{nat}$ is also shown diagrammatically. The length Lt of a segment in this case is given by the relation Lt=Vj×T, where Vj is the jet velocity and T is the duration of a pulse. This value is preferably less than the natural break length to keep an intact segment.

For guidance, a frequency y of 1 kHz is suitable for a 10 mm flight distance (which could constitute a lower limit) at a jet velocity of 10 m/s.

Stimulation frequencies $f_{stim2}$, for unmeasured jets, of the order of 25 or 30 kHz can be suitable; a frequency of 25 kHz at a velocity of 15 m/s corresponds to a 600 μm segment before break. A judicious choice of the stimulation frequency for unmeasured jets can therefore be made from clocks, for example at 125 kHz and 32 MHz, as in an FPGA.

If the charge signal ($V_{THT}$) is for example sinusoidal with a frequency of 32820 Hz (32 Mhz/975), and jets are stimulated at frequencies of $f_{stim1}$=31250 Hz (125000/4) and $f_{stim2}$=25000 Hz (125000/5) the following frequencies are obtained:

- frequencies created starting from a frequency of $f_{stim1}$: 1570 Hz, 29680 Hz and 32820 Hz,
- frequencies created starting from a frequency of $f_{stim2}$: 7820 Hz, 17180 Hz and 32820 Hz, If the charge signal is a pulse signal, additional frequencies will be created by the presence of a rank 3 harmonic:

- frequencies created by the frequency $f_{stim1}$: 4710 Hz, 26540 Hz and 35960 Hz,
- frequencies created by the frequency $f_{stim2}$: 1540 Hz, 23460 Hz and 48460 Hz, In this example, an attempt is made to eliminate the rank 3 harmonic, for example by filtering, to avoid errors between 1570 Hz and 1540 Hz.

More generally, as explained above, the measured jets have a signature at frequency $f_{a1}$ (dependent on $f_{stim1}$ and $f_{THT}$), while unmeasured jets have a signature at frequency $f_{a2}$.

Therefore the objective is to choose $f_{a1}$ such that $f_{a1} \ll f_{a2}$, which makes it easy to separate the signatures; an $f_{a1}/f_{a2}$ ratio<1/5, preferably $f_{a1}/f_{a2}<1/10$, is suitable, for example for filtering using a low pass filter.

Consequently, according to one solution:

- measured jets are stimulated at frequency $f_{stim1}$; by application of the voltage $V_{THT}$ at frequency $f_{THT}$, a signature at $f_{a1}$ (given by the above formula) appears,
- jets that are not measured are stimulated at frequency $f_{stim2}$; by application of the voltage $V_{THT}$ at frequency $f_{THT}$, a signature at frequency $f_{a2}$ (given by the above formula, replacing $f_{stim1}$ by $f_{stim2}$) appears, Therefore $f_{stim1}$ and $f_{stim2}$ are chosen such that $f_{a1} \ll f_{a2}$ (for example: $f_{a1}/f_{a2}<1/2$, preferably f<1/5 or even 1/10), or $f \ll f_{a1}$ (for example: $f_{a2}/f_{a1}<1/2$, preferably $f_{a2}/f_{a1}<1/5$ or even 1/10).

Due to this choice of frequencies, the signatures of jets that are not measured are different from the frequencies of the signature of the measured jet. These different frequencies can be generated by any frequency generator. Thus, signals from jets that are not measured can then be eliminated, by filtering; crosstalk problems are thus eliminated.

As a variant, or in combination with the above solution, $f_{stim1}$ and $f_{stim2}$, and/or $f_{THT}$, can be chosen such that $f_{a1}<f_c<f_{a2}$, (or $f_{a2}<f_c<f_{a1}$) in which $f_c$ is the cutoff frequency of the charge signal amplifier.

In general, the 2 frequencies $f_{stim1}$ and $f_{stim2}$ can be generated by creating a "descriptive" image that is unstacked at a high frequency and is looped back on itself. An example of this image is given in 7C, on which the black dots represent measured and unmeasured jets. The ordinate position is determined as a function of the print speed. This image is binary (there is either stimulation or non-stimulation for each pixel in the image). In the "stimulation" case, a pulse is applied to the stimulated jet. In the example illustrated, if the image scanning clock is 125 kHz, the frequencies obtained are 125/2 kHz and 125/3 kHz, namely 62.5 kHz and 41.66 kHz.

Figure 8A:
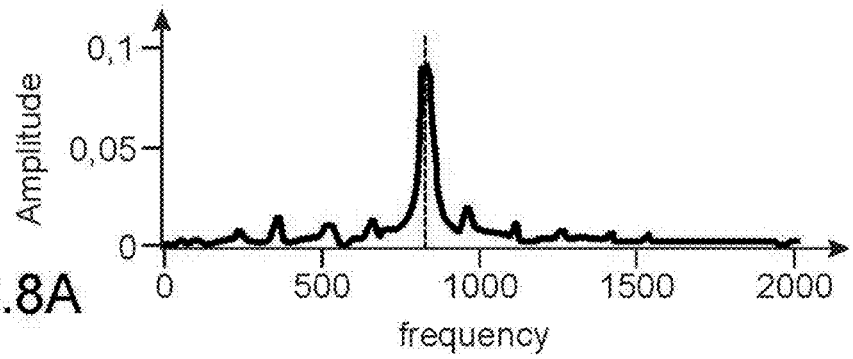
FIGS. 8A and 8B represent the result of a measurement made according to the invention, when the jet is present (FIG. 8A) and when the jet is absent (FIG. 8B)
Figure 8B:
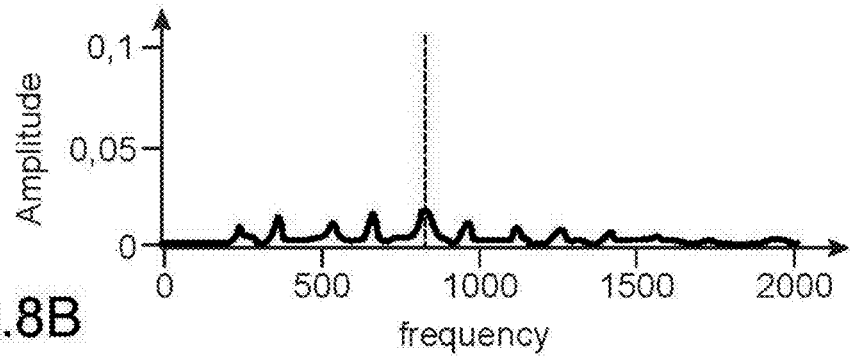

A measured example is given in FIG. 8A when the jet is present and in FIG. 8B when the jet is absent. In this example, the frequency $f_{a1}$ is close to 800 Hz (and $f_{a2}$=9.9 kHz). The signal is acquired through a board NI 6111. The sampling frequency $f_{THT}$ is 200 kHz and the acquisition time is 50 ms.

An FFT is used to display the required line for the present jet; processing is done using a correlation (inter-correlation between target signal and measured temporal signal) for this frequency (faster algorithm than an FFT). It is found that the level for an absent jet (FIG. 8B) is 5 times lower than for a present jet (FIG. 8A).

Figure 9:
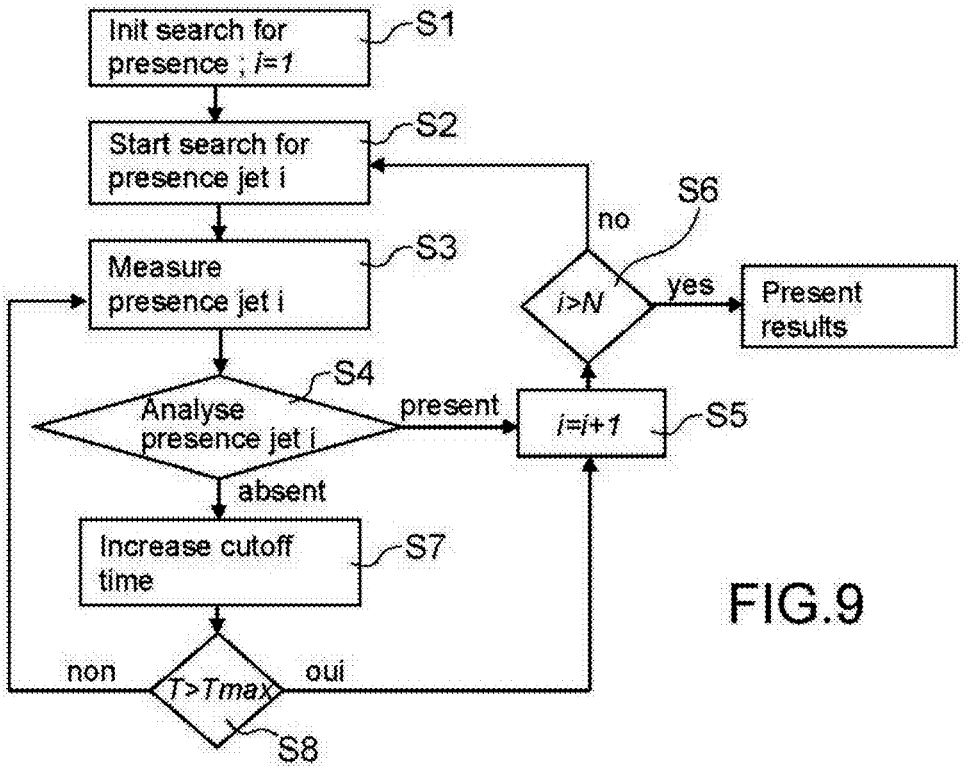
FIG. 9 represents steps in a method according to the invention.

An example of an algorithm for detection of the presence of jets is illustrated in FIG. 9.

The method is initialised at i=1, where i denotes the jet number (step S1).

The search begins on jet i (step S2).

Therefore a method according to the invention as described above is used (step S3), and the measured signal is then analysed (step S4).

If it is concluded that jet i is present, the number of the jet to be analysed is incremented by one unit (step S5), and the method is resumed (step S2), if i is not greater than N (step S6).

Figure 3:
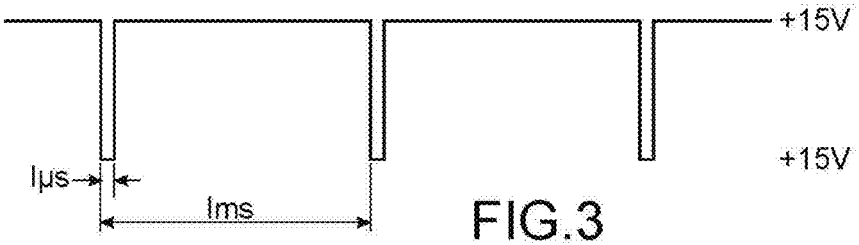
FIG. 3 represents a series of stimulation pulses for a stimulation chamber of a print head, FIGS. 4A-4C diagrammatically represent a sinusoidal THT signal for the charge, a stimulation signal at frequency $F_{stim}$ and the measured signal resulting from the combination of the 2.

Otherwise, the cutoff time (remember that this is the duration of each pulse like those shown on FIG. 3) is increased (step S7), possibly up to a maximum value Tmax (S8). The signal may be undetectable if stimulation is insufficient, and therefore the cutoff time is too short. If the signal is not detectable at Tmax, then it is concluded that the jet is absent.

A method according to the invention can be preceded by or followed by a printout, the electrodes then functioning as described above.

Test results according to the invention will now be presented.

Figure 10:
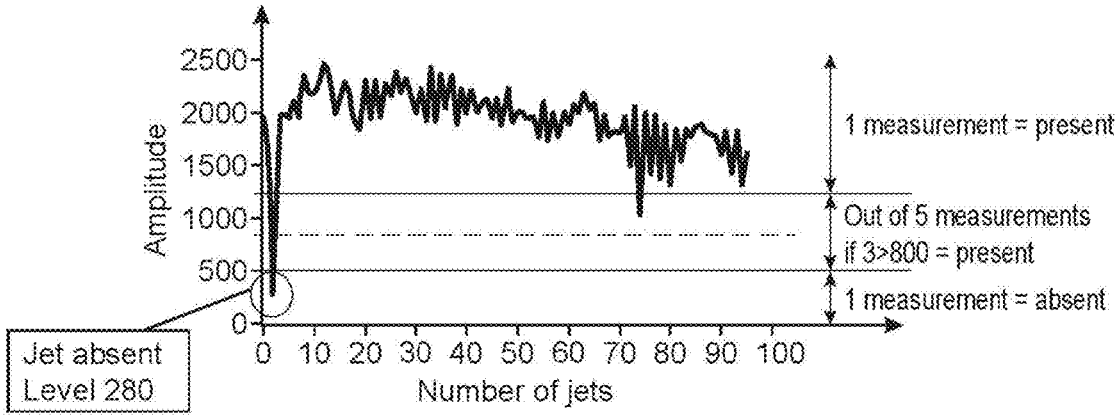
FIG. 10 represents test results according to the invention.

A first test was carried out on a print head in which jet No. 3 is absent. The results are illustrated in FIG. 10 (for this test $f_{stim1}$=41.660 kHz, $f_{stim2}$=62.5 kHz, $f_{THT}$=42.440 kHz).

The difference in level between absent jets and present jets is very significant so that the measurement can be guaranteed.

An algorithm with 3 thresholds is used herein, the 3 thresholds being fixed at 500, 800, 1200.

This type of algorithm enables an unambiguous and fast decision in most cases; in the example given below, only one of the 96 jets requires several measurements.

Another test was made using a 5550 standard alcohol ink. The nominal parameters are the jet velocity of 12 m/s and ink viscosity equal to 6 Cps.

In this example, the measurement was made from charged drops in the zone of the upper electrode or electrode 15 (also called the shielding electrode), shown in FIG. 2; the stimulation amplitude is than adapted so that the break location is in this zone.

The experimental conditions are as follows:

| | |
|---|---|
| Viscosity | 6 cP |
| Jet velocity | 12 m/s |
| Frequency $f_{stim1}$ (measured jet) | 41.66 kHz |
| Frequency $f_{stim2}$ (other jets) | 62.5 kHz |
| $f_{THT}$ | 42.44 kHz |
| Stim Voltage | 32-52 Volts |
| Pressure | 3.5-4.2 bars |

In varying the amplitude from 32 to 52 V, the break distance varies from about 1.5 mm to about 0.7 mm from the corresponding nozzle outlet, such that the break can be adjusted so that it is facing the shielding electrode 15 (the lower part of which is located at 1 mm in this example).

Therefore more generally, it is possible to make a measurement according to the invention with drops that are charged in the upper electrode zone 15 (located at the nozzle outlet) or in the shielding zone.

Other measurements confirm that the measurement system is not sensitive to the jet velocity when the break is in or is facing the shielding electrode. If the break occurs after the shielding electrode at which the charge is applied, the segment will not carry charges and could be incorrectly announced as absent; in this case the measurements are made without changing the stimulation voltage.

The experimental conditions are as follows:

| | |
|---|---|
| Viscosity | 6 cP |
| Jet velocity | 11-13 m/s |
| Frequency $f_{stim1}$ (measured jet) | 41.66 kHz |
| Frequency $f_{stim2}$ (other jets) | 62.5 kHz |
| $f_{THT}$ | 42.44 kHz |
| Stim Voltage | 52 Volts |
| Pressure | 3.5-4.2 bars |

Figure 11A:
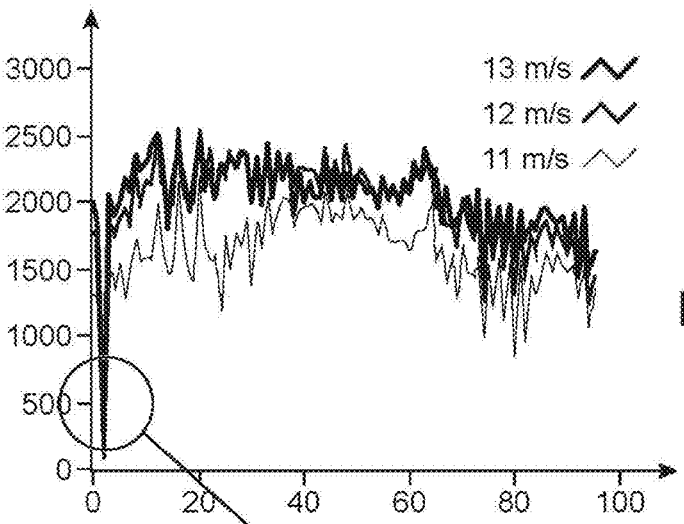
FIGS. 11A-11B and 12A-12B represent other test results according to the invention.
Figure 11B:
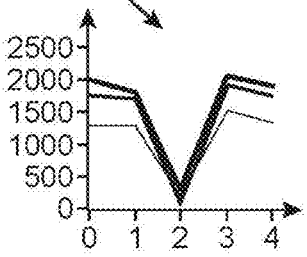

The results are illustrated in FIGS. 11A and 11B (the latter being an enlargement of the zone identified by a circle in FIG. 11A) for the 3 velocities 11 m/s, 12 m/s, 13 m/s. The results are the same regardless of the jet velocity.

Other measurements confirm that the measurement system is not sensitive to viscosity measurements, provided that the break is in the shielding electrode (for the same reason as that mentioned above).

The experimental conditions are as follows:

| | |
|---|---|
| Viscosity | 4.5 to 6.5 cP |
| Vjet | 12 m/s |
| Frequency $f_{stim1}$ (measured jet) | 41.66 kHz |
| Frequency $f_{stim2}$ (other jets) | 62.5 kHz |
| $f_{THT}$ | 42.44 kHz |
| Stim Voltage | 52 Volts |
| Pressure | 3.1 to 4.1 Bars |

Figure 12A:
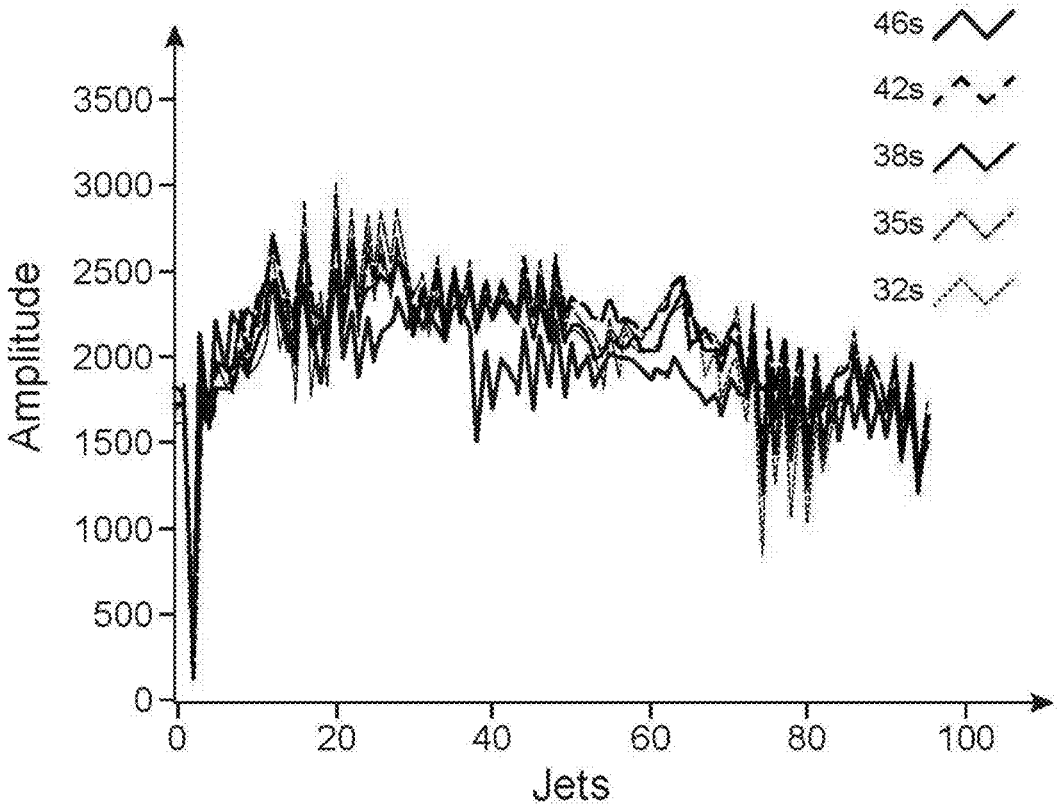
Figure 12B:
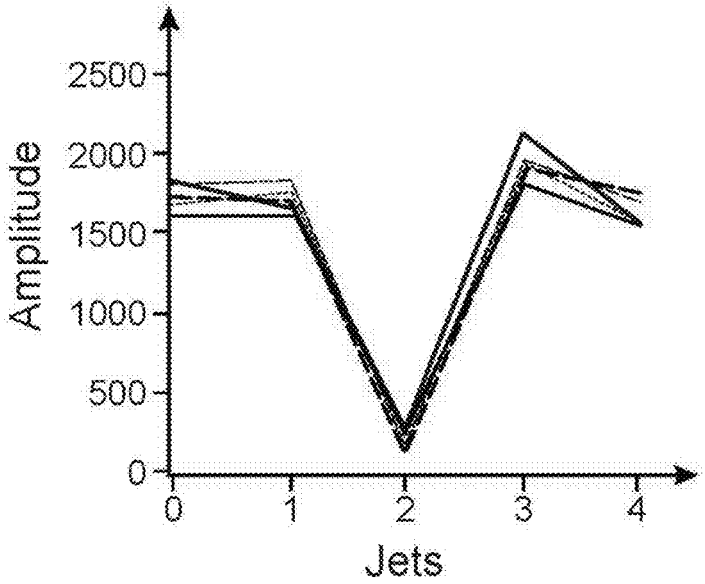

The results are illustrated in FIGS. 12A and 12B (the latter being an enlargement of the zone identified by a circle in FIG. 12A) for the 5 tested viscosities. The results are the same regardless of the viscosity.

Regardless of which embodiment is envisaged, the instructions to apply the required voltages to the electrodes and/or to activate the stimulation means of each stimulation chamber are sent by control means (also called "controller"). Other instructions will enable circulation of ink under pressure towards the means $\mathbf{4}_1$-$\mathbf{4}_n$, then will enable generation of jets as a function of motifs to be printed on a support 8.

These control means can also perform processing, for example the spectral analysis or analyses of signals detected by a method according to the invention or by a device according to the invention.

These control means may for example be made in the form of a processor or a microprocessor, or an electric or electronic circuit capable of implementing or being programmed to implement a method according to the invention.

This controller controls means of stimulating the stimulation chambers, the means of pumping the printer and particularly the catcher, and the means of opening and closing valves on the trajectory of the different fluids (ink, solvent, gas). The control means can also memorise data, for example data about detected charge measurements and/or ink levels in one or more reservoirs, and can process these data if required.

Figure 13:
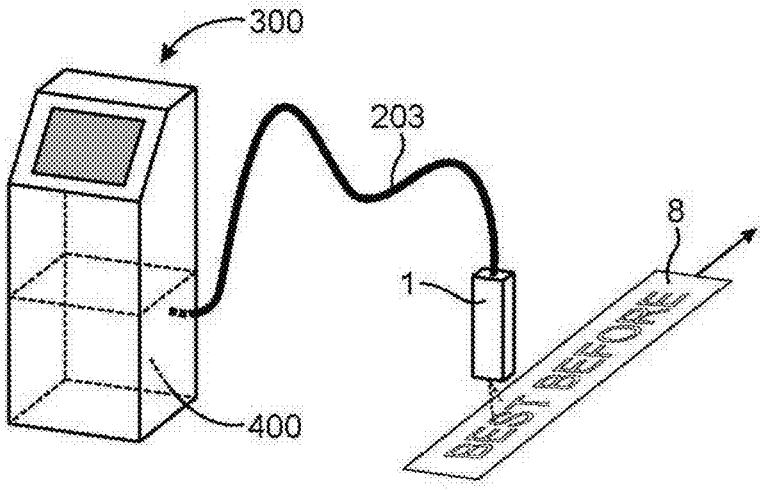
FIG. 13 represents the main modules of an inkjet printer.

FIG. 13 shows the main blocks of an inkjet printer that can implement one or several of the embodiments described above. The printer comprises a console 300, a compartment 400 containing particularly the ink and solvent conditioning circuits, and reservoirs for ink and solvents (in particular, the reservoir to which ink recovered by the catcher is returned). In general, the compartment 400 is in the lower part of the console. The top part of the console comprises the control and instrumentation electronics and display means. The console is hydraulically and electrically connected to a print head 100 through an umbilical 203.

A portal frame not shown is used to install the print head facing a print support 8, which moves along a direction materialised by an arrow. This direction is perpendicular to an alignment axis of the nozzles.

The drop generator comprises nozzles and a cavity of the type according to one of the embodiments described above, with electrodes 4*a*, 4*b* and means of applying voltages to them for printing or alternatively, a method of detecting the presence of a jet according to the invention.

The invention is applicable particularly in applications in which the air or gas flow in the cavity is large. For example, the flow may be of the order of several hundred l/h, for example between 50 l/h or 100 l/h and 500 l/h, for example about 300 l/h. These values are particularly applicable to the case of a nozzle plate with 64 nozzles, but the invention is also applicable to the case of a nozzle plate with a smaller number of nozzles, for example 32, or to the case of a nozzle plate with a larger number of nozzles, for example 128. The jet velocity may be between 5 m/s and 20 m/s, for example it is about 15 m/s.

Figure 14:
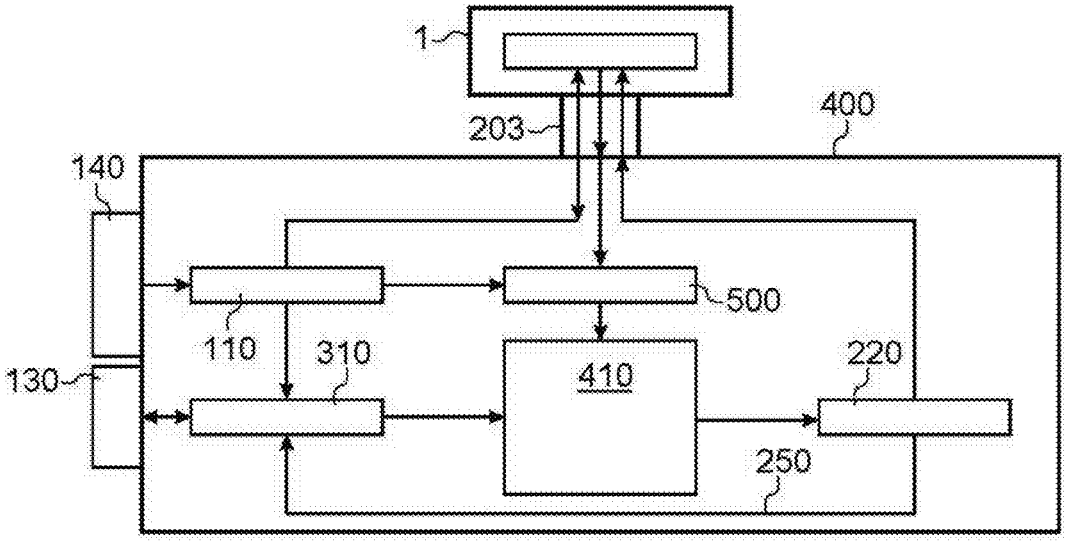
FIG. 14 represents a structure of an inkjet printer to which this invention can be applied.

An example of a fluid circuit 400 of a printer to which the invention can be applied is illustrated in FIG. 14. This fluid circuit 400 comprises a plurality of means 410, 500, 110, 220, 310, each associated with a special function. There is also the head 1 and the umbilical 203.

This circuit 400 is associated with a removable ink cartridge 130 and a solvent cartridge 140 that is also removable.

Reference 410 designates the main reservoir, that collects a mix of solvent and ink.

Reference 110 designates the assembly of means of drawing off and possibly storing solvent from a solvent cartridge 140 and providing solvent thus drawn off to other parts of the printer, either to supply solvent to the main reservoir 410, or to clean or maintain one or several other parts of the machine.

Reference 310 designates the assembly of means of drawing off ink from an ink cartridge 130 and providing ink thus drawn off to supply the main reservoir 410. As can be seen on this figure, according to the embodiment presented herein, these same means 310 are used to send solvent to the main reservoir 410 and from the means 110.

At the outlet from the reservoir 410, an assembly of means globally designated as reference 220 applies pressure to the ink drawn off from the main reservoir, and sends it to the print head 1. According to one embodiment illustrated herein by the arrow 250, it is also possible to use these means 220 to send ink to the means 310, and then again to the reservoir 410, which enables recirculation of ink inside the circuit. This circuit 220 is also used to drain the reservoir in the cartridge 130 and to clean connections of the cartridge 130.

The system shown on this figure also includes means 500 of recovering fluids (ink and/or solvent) that return from the print head, more precisely from the catcher 7 of the print head or the head rinsing circuit. Therefore these means 500 are arranged downstream from the umbilical 203 (relative to the direction of circulation of fluids that return from the print head).

As can be seen in FIG. 14, the means 110 can also be used to send solvent to these means 500 directly without passing through the umbilical 203 or through the print head 1 or through the catcher.

The means 110 can comprise at least 3 parallel solvent supplies, one to the head 1, the $2^{nd}$ to the means 500 and the $3^{rd}$ to the means 310.

Each of the means described above is provided with means such as valves, preferably solenoid valves, that can direct the fluid concerned to the chosen direction. Thus, starting from means 110, solvent can be sent exclusively to the head 1, or to means 500 or to means 310.

Each of the means 500, 110, 210, 310 described above can be provided with a pump to treat the fluid concerned (namely $1^{st}$ pump, $2^{nd}$ pump, $3^{rd}$ pump, $4^{th}$ pump respectively). These different pumps perform different functions (the functions of each of their means) and are therefore different from each other, even though these different pumps may be of the same type or similar types (in other words none of these pumps performs 2 of these functions).

In particular, the means 500 comprise a pump ($1^{st}$ pump) that pumps the fluid recovered from the print head as explained above, and sends it to the main reservoir 410. This pump is dedicated to the recovery of fluid from the print head and is physically different from the $4^{th}$ pump of means 310 dedicated to the transfer of ink or the $3^{rd}$ pump of means 210 dedicated to pressurisation of ink at the outlet from reservoir 410.

The means 110 comprise a pump (the $2^{nd}$ pump) that pumps solvent and sends it to the means 500 and/or the means 310 and/or to the print head 1.

Such a circuit 400 is controlled by the control means described above that are usually contained in the console 300 (FIG. 13).

The control means (or the controller) of a printer according to the invention control the characteristics (amplitude, frequencies) of voltages applied to the electrodes and the stimulation means of each stimulation chamber. They also control processing of signals detected by the charge detection means, for example the catcher or the electrode.

The invention claimed is:

1. Method for detecting the presence of a jet from a multi-jet print head of an inkjet printer comprising a plurality of nozzles, at least one $1^{st}$ and one 2nd deviation electrode for each jet, in which:

said inkjet is ejected by one of the nozzles, stimulated at a frequency $f_{stim1}$, and a charge signal is induced in said inkjet at a frequency $f_{THT}$, said charge signal being sampled at said frequency $f_{stim1}$, $f_{THT}$ not being an integer multiple or sub-multiple of $f_{stim1}$, said charge signal is detected and at least one spectral component of said charge signal is used to detect the presence of said jet.

2. Method according to claim 1, in which:

said charge signal is induced in said inkjet by a voltage $V_{THT}$ at said frequency $f_{THT}$ applied to one of the deviation electrodes, the other deviation electrode being grounded; or the print head comprises at least one $3^{rd}$ electrode, to which the voltage $V_{THT}$ at said frequency $f_{THT}$ is applied, the deviation electrodes being grounded.

3. Method according to claim 1, said charge signal comprising a spectral component at at least one frequency $f_{a1}$ defined by:

$$f_{a1} = \left(\frac{f_{THT}}{f_{stim1}} - \left\lfloor \frac{f_{THT}}{f_{stim1}} \right\rfloor\right) * f_{stim1}$$

in which the function $\lfloor\ \rfloor$ designates the integer part.

4. Method according to claim 1, in which at least some of the jets other than the tested jet are stimulated at a frequency $f_{stim2}$ different from $f_{stim1}$.

5. Method according to claim 3, in which an ink jet is produced by each nozzle at a frequency $f_{stim1}$ for the measured jet, and at a frequency $f_{stim2}$ for at least part of the other jets, $f_{stim1}$ and $f_{stim2}$ being such that:

$f_{a1} \ll f_{a2}$ or $f_{a2} \ll f_{a1}$, and/or: $f_{a1} < f_c < f_{a2}$, or $f_{a2} < f_c < f_{a1}$, in which $f_c$ is the cutoff frequency of an amplifier or a filter of the charge signal, $f_{a2}$ being defined by:

$$f_{a2} = \left(\frac{f_{THT}}{f_{stim2}} - \left\lfloor \frac{f_{THT}}{f_{stim2}} \right\rfloor\right) * f_{stim2}$$

in which the function $\lfloor\ \rfloor$ designates the integer part.

6. Method according to claim 1, in which a plurality of spectral components of said charge signal is detected, the sum of the intensities of several of these spectral components being made to detect the presence of said jet.

7. Method according to claim 1, in which said charge signal is detected:

by a recovery catcher of a jet not used for printing, this catcher being at least partly made of a conducting material, or by an electrode or by a charge detector.

8. Method according to claim 1, in which the presence or absence of a jet from the multi jet print head is detected for each jet from the print head successively.

9. Method of printing using an inkjet printer comprising a multi-jet print head, comprising:

a step to print at least one motif on a support, stop printing and then implement a method, according to claim 1, for detecting the presence of one or several jets of said multi-jet print head; or :

implementation of a method, according to claim 1, for detecting the presence of one or several jets of said multi-jet print head.

stop the detection method, then implement a step to print at least one motif on a support.

10. Method of printing according to claim 9, in which, during a print step, variable voltages in phase opposition are applied to the $1^{st}$ and 2nd deviation electrodes.

11. Print device of the inkjet printer type comprising a multi-jet print head, comprising:

a printer to print at least one motif on a support, a controller to stop printing and then to implement a method, according to claim 1, for detecting the presence of one or several jets of said multi-jet print head;

or comprising:

a detector to detect the presence of one or several jets of said multi-jet print head according to claim 1, a controller to stop the detection, and then to control a printer to print at least one motif on a support.

12. Device for detecting the presence of a jet from a multi-jet print head of an inkjet printer comprising a plurality of nozzles, at least one $1^{st}$ and one 2nd deviation electrode for each jet, this device comprising:

an actuator to eject said inkjet through one of the nozzles, and to stimulate it at a frequency $f_{stim1}$, an electrode to induce a charge signal to the jet at a frequency $f_{THT}$, said charge signal being sampled at said frequency $f_{stim1}$, $f_{THT}$ not being an integer multiple or sub-multiple of $f_{stim1}$, a detector to measure said charge signal and to detect at least one spectral component of said charge signal.

13. Device according to claim 12, comprising a voltage supply to apply a voltage $V_{THT}$ at said frequency $f_{THT}$ to one of the deviation electrodes, or to a $3^{rd}$ electrode.

14. Device according to claim 12, said charge signal comprising a spectral component at at least one frequency $f_{a1}$ defined by:

$$f_{a1} = \left(\frac{f_{THT}}{f_{stim1}} - \left\lfloor \frac{f_{THT}}{f_{stim1}} \right\rfloor\right) * f_{stim1}$$

in which the function ⌊ ⌋ designates the integer part.

15. Device according to claim 12, comprising actuators:

to eject inkjets through nozzles or several other nozzles, at a frequency $f_{stim2}$ different from $f_{stim1}$;

or said charge signal comprising a spectral component at at least one frequency $f_{a1}$ defined by:

$$f_{a1} = \left(\frac{f_{THT}}{f_{stim1}} - \left\lfloor \frac{f_{THT}}{f_{stim1}} \right\rfloor\right) * f_{stim1}$$

in which the function ⌊ ⌋ designates the integer part, said actuators producing at least some of the other jets at a frequency $f_{stim2}$, $f_{stim1}$ and $f_{stim2}$ being such that:

$f_{a1} \ll f_{a2}$, and/or: $f_{a1} < f_c < f_{a2}$, in which $f_c$ is the cutoff frequency of an amplifier or a filter of the charge signal connected to the detection means, $f_{a2}$ being defined by:

$$f_{a2} = \left(\frac{f_{THT}}{f_{stim2}} - \left\lfloor \frac{f_{THT}}{f_{stim2}} \right\rfloor\right) * f_{stim2}$$

in which the function ⌊ ⌋ designates the integer part.

16. Device according to claim 12, comprising a detector to detect a plurality of spectral components of said charge signal, and taking the sum of the intensities of several of these spectral components.

17. Device according to claim 12, comprising a recovery catcher of a jet not used for printing, this catcher being at least partly made of a conducting material, or an electrode or a charge detector and means of processing said charge signal detected by this catcher or this electrode or this charge detector.

18. Device according to claim 12, capable of detecting the presence or absence of a jet from the multi jet print head for each jet from the print head successively.

19. Device according to claim 12, capable of using an algorithm with several thresholds, for example 3 thresholds, to process the charge signal or at least one of its spectral components.

20. Inkjet printer comprising:

a multi-jet print head, a device to detect the presence of a jet from the print head according to claim 12, a circuit to supply ink and/or solvent to the print head.

* * * * *